US007427344B2

(12) United States Patent
Han et al.

(10) Patent No.: US 7,427,344 B2
(45) **Date of Patent: *Sep. 23, 2008**

(54) METHODS FOR DETERMINING ORGANIC COMPONENT CONCENTRATIONS IN AN ELECTROLYTIC SOLUTION

(75) Inventors: Jianwen Han, Danbury, CT (US); MacKenzie E. King, Southbury, CT (US)

(73) Assignee: Advanced Technology Materials, Inc., Danbury, CT (US)

( * ) Notice: Subject to any disclaimer, the term of this patent is extended or adjusted under 35 U.S.C. 154(b) by 322 days.

This patent is subject to a terminal disclaimer.

(21) Appl. No.: 11/318,129

(22) Filed: Dec. 23, 2005

(65) Prior Publication Data

US 2006/0102475 A1 May 18, 2006

Related U.S. Application Data

(62) Division of application No. 10/833,194, filed on Apr. 27, 2004, now Pat. No. 6,984,299.

(51) Int. Cl.
*C25D 21/14* (2006.01)

(52) U.S. Cl. ..... 205/81; 205/83; 205/101; 205/296; 205/787

(58) Field of Classification Search ..... 205/81, 205/83, 101, 296, 787
See application file for complete search history.

(56) References Cited

U.S. PATENT DOCUMENTS

| | | | |
|---|---|---|---|
| 2,707,166 | A | 4/1955 | Brown et al. |
| 2,707,167 | A | 4/1955 | Hoover et al. |
| 2,830,014 | A | 4/1958 | Gundel et al. |
| 2,884,366 | A | 4/1959 | Anderson et al. |
| 2,898,282 | A | 8/1959 | Flook, Jr. et al. |
| 3,101,305 | A | 8/1963 | Roth et al. |
| 3,276,979 | A | 10/1966 | Strauss et al. |
| 3,288,690 | A | 11/1966 | Creutz et al. |
| 3,655,534 | A | 4/1972 | Kampe |
| 3,725,220 | A | 4/1973 | Kessler |

(Continued)

FOREIGN PATENT DOCUMENTS

DE 19911447 A1 12/2000

(Continued)

OTHER PUBLICATIONS

Bard, Allen J., et al., Electrochemical Methods: Fundamentals and Applications, 2nd Edition, 2001, pp. 15-16, Publisher: John Wiley & Sons, Inc., Published in : New York.

(Continued)

*Primary Examiner*—Susy Tsang-Foster
*Assistant Examiner*—William T Leader
(74) *Attorney, Agent, or Firm*—Steven J. Hultquist; Intellectual Property/Technology Law; Maggie Chappuis

(57) ABSTRACT

The present invention relates to a method and apparatus for determining organic additive concentrations in a sample electrolytic solution, preferably a copper electroplating solution, by measuring the double layer capacitance of a measuring electrode in such sample solution. Specifically, the present invention utilizes the correlation between double layer capacitance and the organic additive concentration for concentration mapping, based on the double layer capacitance measured for the sample electrolytic solution.

20 Claims, 1 Drawing Sheet

U.S. PATENT DOCUMENTS 3,798,138 A 3/1974 Ostrow et al.
3,883,414 A 5/1975 Fujinaga et al.
3,910,830 A 10/1975 Mayse
3,950,234 A 4/1976 Faulkner et al.
3,972,789 A 8/1976 Eppensteiner et al.
3,996,124 A 12/1976 Eaton et al.
4,038,161 A 7/1977 Eckles et al.
4,071,429 A 1/1978 Wagenknecht et al.
4,119,532 A 10/1978 Park
4,132,605 A 1/1979 Tench et al.
4,260,950 A 4/1981 Hadden et al.
4,305,039 A 12/1981 Steuernagel et al.
4,317,002 A 2/1982 Spicer
4,388,165 A 6/1983 Koshiishi et al.
4,496,454 A 1/1985 Berger
4,498,039 A 2/1985 Galwey et al.
4,529,495 A 7/1985 Marsoner
4,568,445 A 2/1986 Cates et al.
4,589,958 A 5/1986 Alexander et al.
4,595,462 A 6/1986 Vangaever et al.
4,707,378 A 11/1987 McBride et al.
4,772,375 A 9/1988 Wullschleger et al.
4,812,210 A 3/1989 Bonivert et al.
4,849,330 A 7/1989 Humphries et al.
4,917,774 A 4/1990 Fisher
4,917,777 A 4/1990 Fisher
5,017,860 A 5/1991 Germer et al.
5,074,157 A 12/1991 Marsoner et al.
5,131,999 A 7/1992 Gunasingham
5,162,077 A 11/1992 Bryan et al.
5,192,403 A 3/1993 Chang et al.
5,223,118 A 6/1993 Sonnenberg et al.
5,268,087 A 12/1993 Lu
5,288,387 A 2/1994 Ito et al.
5,296,123 A 3/1994 Reddy et al.
5,316,649 A 5/1994 Kronberg
5,320,721 A 6/1994 Ludwig et al.
5,325,038 A 6/1994 Banzai et al.
5,352,350 A 10/1994 Andricacos et al.
5,404,018 A 4/1995 Yasuda et al.
5,447,802 A 9/1995 Tobiyama et al.
5,462,645 A 10/1995 Albery et al.
5,612,698 A 3/1997 Reay
5,635,043 A 6/1997 Turyan et al.
6,022,470 A 2/2000 Yarnitzky
6,210,640 B1 4/2001 Ruth et al.
6,231,743 B1 5/2001 Etherington
6,254,760 B1 7/2001 Shen et al.
6,270,651 B1 8/2001 Essalik et al.
6,280,602 B1 8/2001 Robertson
6,288,783 B1 9/2001 Auad
6,365,033 B1 4/2002 Graham et al.
6,366,794 B1 4/2002 Moussy et al.
6,395,152 B1 5/2002 Wang
6,409,903 B1 6/2002 Chung et al.
6,458,262 B1 10/2002 Reid
6,459,011 B1 10/2002 Tarr et al.
6,478,950 B1 11/2002 Peat et al.
6,495,011 B2 12/2002 Robertson
6,558,519 B1 5/2003 Dodgson et al.
6,569,307 B2 5/2003 Blachier et al.
6,572,753 B2 6/2003 Chalyt et al.
6,592,737 B1 7/2003 Robertson
6,645,364 B2 11/2003 Calvert et al.
6,673,226 B1 * 1/2004 Kogan et al. ..... 205/81
6,709,568 B2 3/2004 Han et al.
6,758,955 B2 7/2004 Robertson
6,758,960 B1 7/2004 Robertson
6,808,611 B2 10/2004 Sun et al.
6,827,839 B2 12/2004 Sonnenberg et al.
6,974,531 B2 12/2005 Andricacos et al.
6,984,299 B2 1/2006 Han et al.
7,022,215 B2 4/2006 Schomburg
7,094,323 B2 8/2006 King et al.
2002/0070708 A1 6/2002 Wu
2003/0080000 A1 5/2003 Robertson
2004/0040842 A1 3/2004 King et al.
2004/0055888 A1 3/2004 Wikiel et al.
2004/0065561 A1 4/2004 Chalyt et al.
2005/0016847 A1 1/2005 Buehler
2005/0067304 A1 3/2005 King et al.
2005/0109624 A1 5/2005 King et al.
2005/0224370 A1 10/2005 Liu et al.
2005/0241948 A1 11/2005 Han et al.
2005/0247576 A1 11/2005 Tom et al.
2006/0266648 A1 11/2006 King et al.

FOREIGN PATENT DOCUMENTS

EP 0 302 009 A1 7/1988
JP 2001-073183 A 3/2001
WO WO - 01/29548 A1 4/2001

OTHER PUBLICATIONS

Liu, Yonghui, Testing Technology of Electrochemistry, (English relevance attached), 1987, p. 159, Published in: Beijing.
Milchev, Alexander, et al., A glavanostatic study of electrochemical nucleation, Journal of Electroanalytical Chemistry, Aug. 1992, pp. 93-102, vol. 333, No. 1 and 2.
Oldham, Keith B., et al., Fundamentals of Electrochemical Science, 1994, pp. 328-332, Publisher: Academic Press, Inc., Published in: San Diego.
Alwash, S. H. et al., A rotating disc electrode with heat transfer facilities for corrosion studies, Corrosion Science, 1987, pp. 383-390, vol. 27, No. 4.
Barz, H., et al., Measurement of the surface temperature of rotating electrodes, J. Electroanal. Chem., 1976, pp. 415-418, vol. 69.
Cerna, N., Determination of chlorides in an acid copper-plating bath, Povrchove Upravy, 1973, pp. 11-12, vol. 13, No. 6.
Cheng, X. L., et al., Analysis of organic additives in copper-plating brightener by high performance liquid chromatography, Se. Pu., Nov. 1999, pp. 602-603, vol. 17, No. 6.
Dikusar, A. I., et al., Thermokinetic instability of electrode processes, J. Electroanal. Chem., 1986, pp. 11-23, vol. 207.
Freeman, J.E., et al., A fiber-optic absorption cell for remote determination of copper in industrial electroplating baths, Analytica Chimica Acta, 1985, pp. 121-128, vol. 177.
Freitag, Walter O., et al., Determination of the individual additive components in acid copper plating baths, Plat. Surf. Fin., Oct. 1983, pp. 55-60, vol. 70, No. 10.
Healy, John P., et al., The chemistry of the additives in an acid copper electroplating bath: Part II. The instability 4,5-dithiaoctane-1, . . . , J. Electoanal. Chem., Oct. 1992, pp. 167-177, vol. 338, No. 1-2.
Healy, John P., et al., The chemistry of the additives in an acid copper electroplating bath: Part III. The mechanism of brightening by 4,5- . . . , J. Electroanal. Chem., Oct. 1992, pp. 179-187, vol. 338, No. 1-2.
Huiliang, Huang, et al., Flow potentiometric and constant-current stripping analysis for mercury(II) with gold, platinum and carbon fibre . . . , Analytica Chimica Acta, 1987, pp. 1-9, vol. 201.
Kim, Jae Jeong, et al., Catalytic behavior of 3-mercapto-1-propane sulfonic acid on Cu electrodeposition and its effect on Cu film properties . . . , J. Electronanal. Chem., Jan. 30, 2003, pp. 61-66, vol. 542, No. 1.
Kruglikov, S. S., et al., The effect of some primary and secondary brighteners on the double layer capacitance in nickel electrodeposition, Electrochimica Acta, Sep. 1967, pp. 1263-1271, vol. 12, No. 9.
Merriam-Webster's Collegiate Dictionary: 10th Ed., 1998, pp. 328, 361, 478.
METROHM, Product description of 731 Relay Box, Downloaded May 11, 2005 from http://www.metrohm.com/products/05/acc/731/731.html, May 11, 2005.
METROHM, Product description of 772 Pump Unit, Downloaded May 11, 2005 from http://www.metrohm.com/products/05/acc/772/772.html, May 11, 2005.

METROHM, Product description of MVA-3 voltammetry system, Downloaded May 11, 2005 from http://www.metrohm.com/products/06/mva/mva03/mva03.html, May 6, 2004.
METROHM, Product description of Titrando Dosino, http://www.metrohm.com/titrando/products/units/800/800.html, 2003.
METROHM, Product descripton of Titrando PC Control, Downloaded May 11, 2005 from http://www.metrohm.com/titrando/products/control/pc/pc.html, 2004.
Seisler, H.W., et al., Near Infrared Spectroscopy, Near Infrared Spectroscopy, 2002, Publisher: Wiley.
Skoog, Douglas A., et al., Principles of Instrumental Analysis, 3rd Ed., 1985, pp. 332-337, Publisher: Harcourt College Publishers.
Tench, Dennis, et al., Cyclic pulse voltammetric stripping analysis of acid copper plating baths, J. Electrochem. Soc., Apr. 1985, pp. 831-834, vol. 132, No. 4.
Vereecken, P.M., et al., The chemistry of additives in damascene copper plating, IBM J. Res. Dev., Jan. 2005, pp. 3-18, vol. 49, No. 1.
Wojciechowski, Marek, et al., Square-wave anodic stripping voltammetry of lead and cadmium at cylindrical graphite fiber microelectrodes with . . . , Analytica Chimica Acta, 1991, pp. 433-445, vol. 249, No. 2.
Wikipedia, Universal Serial Bus—Wikipedia , Downloaded May 11, 2005 from hhtp://en.wikipedia.org/wiki/USB, May 11, 2005.
Wyche, et al., Constant low-voltage drop rotating electrode assembly, Electrochemical Technology, 1966, pp. 447, vol. 4, No. 7-8.
"Aldrich Handbook of Fine Chemicals and Laboratory Equipment", 2003-2004, pp. 500, 501 and 1634, Publisher: Aldrich Chemical Co., Published in: Milwaukee, WI.

* cited by examiner

METHODS FOR DETERMINING ORGANIC COMPONENT CONCENTRATIONS IN AN ELECTROLYTIC SOLUTION

CROSS-REFERENCE TO RELATED APPLICATIONS

This application is a divisional application of U.S. patent application Ser. No. 10/833,194, entitled "Methods For Determining Organic Component Concentrations In An Electrolytic Solution", filed on Apr. 27, 2004, and issued as U.S. Pat. No. 6,984,299 on Jan. 10, 2006.

BACKGROUND OF THE INVENTION

1. Field of the Invention

The present invention relates to methods and apparatuses for determining organic component concentrations in an electrolytic solution, and more specifically to determination of organic component concentrations in a copper electroplating solution.

2. Description of the Related Art

In electrochemical deposition (ECD) process, the rigorous control of the relative proportions of respective inorganic and organic ingredients in the ECD bath is critical to the achievement of satisfactory results in the rate of metal film formation and the quality of the film so formed. During the use of the plating bath solution, the plating process may be affected by depletion of inorganic components and organic additives as well as by organic byproduct formation. The ECD bath chemistry therefore must be maintained by periodic replacement of a part or the entire ECD bath. It is therefore important to continuously or periodically monitor the concentrations of inorganic and/or organic components in the ECD bath, and responsively add respective components to the bath to maintain the composition of the bath in an effective state for the electrochemical deposition operation.

It is therefore one object of the present invention to provide an improved method for measuring concentrations of one or more organic components in an ECD bath.

Other objects and advantages will be more fully apparent from the ensuring disclosure and appended claims.

SUMMARY OF THE INVENTION

The present invention in one aspect relates to a method for determining concentration of an organic component in a sample electrolytic solution. Such method comprises the steps of:

(a) applying a potential step to the sample electrolytic solution by using at least a working electrode and a reference electrode;

(b) measuring double layer capacitance of the working electrode in the sample electrolytic solution under the applied potential step; and (c) determining the concentration of the organic component in the sample electrolytic solution, based on the double layer capacitance measured in step (b).

Another aspect of the present invention relates to an apparatus for measuring concentration of an organic component in a sample electrolytic solution, comprising:

(a) a measuring chamber containing a working electrode and a reference electrode, for receiving at least a portion of the sample electrolytic solution;

(b) an electrical source for applying a potential step to the sample electrolytic solution through the working and reference electrodes;

(c) means for measuring double layer capacitance of the working electrode in said sample electrolytic solution under the applied potential step; and (d) computational means for determining the concentration of the organic component in said sample electrolytic solution, based on the double layer capacitance measured for the working electrode in the sample electrolytic solution.

Other aspects, features and embodiments of the present invention will be more fully apparent from the ensuing disclosure and appended claims.

DETAILED DESCRIPTION OF THE INVENTION, AND PREFERRED EMBODIMENTS THEREOF

Figure 1:
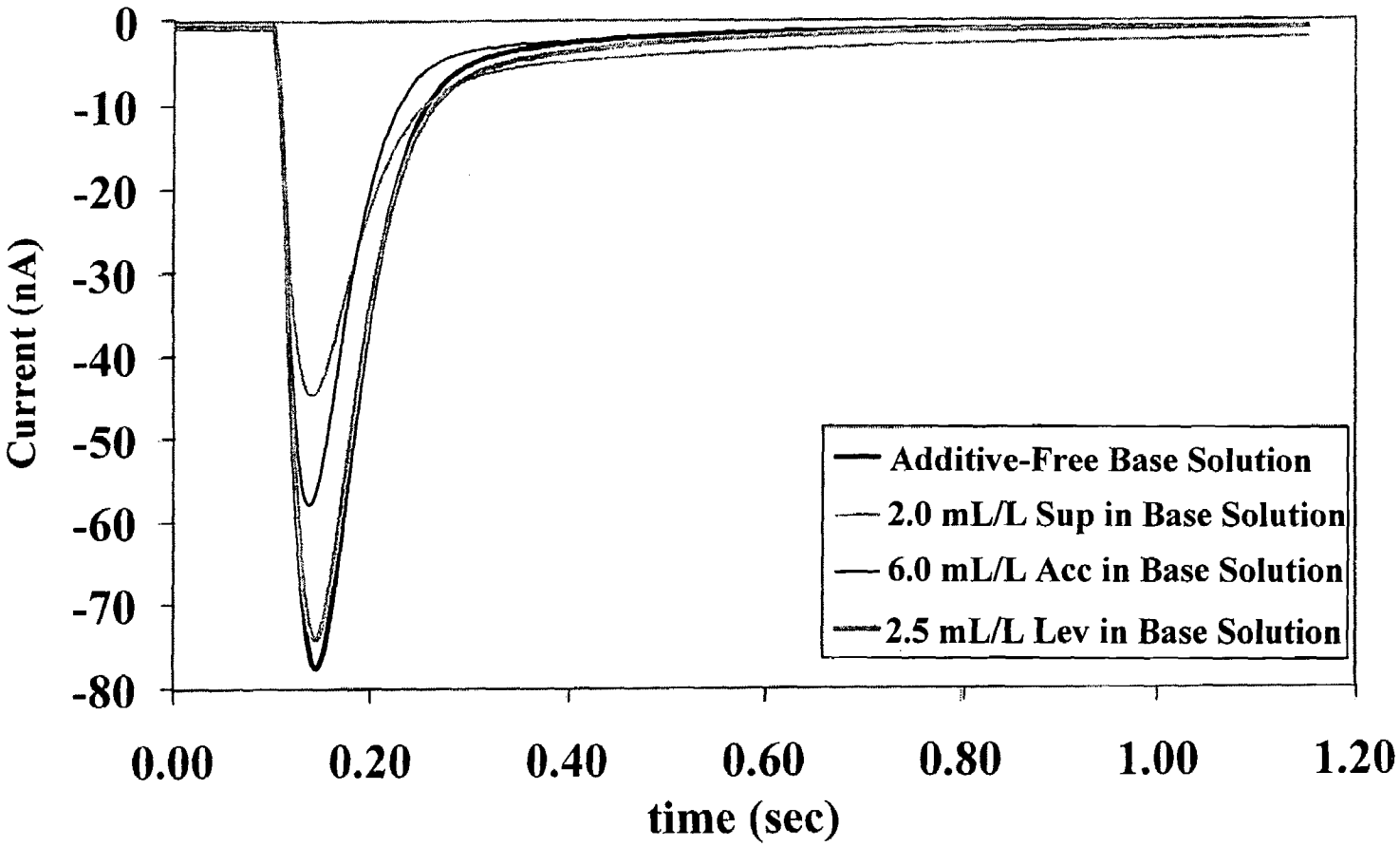
FIG. 1 shows the current response curves measured for four different electrolytic solutions over time under an initial potential step of about −0.208V.

The boundary between a measuring electrode and an electrolytic solution is called an interface. The electrolytic solution is a first phase in which charge is carried by the movement of ions, and the measuring electrode is a second phase in which charge is carried by the movements of electrons.

Two types of processes occur at the electrode-solution interface: (1) the faradaic process involves actual electron transfers between the measuring electrode and the electrolytic solution; and (2) the non-faradaic process involves adsorption and desorption of organic species onto and from the electrode surface where no charge actually cross the interface.

During non-faradaic process, although no charge actually cross the interface, external transient currents are present when the electrical potential, electrode surface area, or the composition of the electrolytic solution changes. These transient currents flow to charge or discharge the electrode-solution interfacial region, which is generally referred to as an electrical double layer.

The capacitance of such electrical double layer ($C_d$) is a function of the applied electrical potential (E), the composition and concentration of the electrolytic solution, and the active electrode surface area. When the applied electrical potential and the active electrode surface area are constant, the double layer capacitance is directly correlative to the composition and concentration of the electrolytic solution.

Therefore, the present invention in one aspect provides a method for measuring the organic additive (i.e., suppressors, accelerators, and levelers) concentrations in a metal electroplating solution, more preferably a copper electroplating solution, based on the double layer capacitance of a working electrode that is immersed in such metal electroplating solution.

Under a given initial electrical potential or potential step (E), the metal electroplating solution demonstrates a current response that is characterized by an initial current peak or maximum current ($I_{max}$) at initial time $t_0$ and an exponentially decaying current (I) at subsequent time t, which are determined by:

$$I_{\max} = \frac{E}{R_s}; \quad \text{(I)}$$

-continued $$I = I_{\max} \times e^{\left(\frac{t}{R_s C_d}\right)} \quad \text{(II)}$$

where $R_s$ is the electrical resistance of the electrolytic solution, and e is the base for natural exponential.

When $t=R_sC_d$, the current I has decreased to about 37% of the initial current peak, as follows:

$$I=I_{max}\times e^{(-1)}=0.368\times I_{max} \quad \text{(III)}$$

The value of $R_sC_d$ is usually referred to as the time constant $t_c$, which is characteristic to the given electrode-solution interface.

From equations (I)-(III), one can express the double layer capacitance $C_d$ as:

$$C_d = \frac{t_c \times I_{\max}}{E} \quad \text{(IV)}$$

Therefore, by measuring the current peak $I_{max}$, the time constant $t_c$ required for the current to decrease to about 37% of the current peak $I_{max}$, and the initial potential step E, the double layer capacitance $C_d$ of the measuring electrode in the sample electroplating solution can be determined quantitatively.

The current response of an electrolytic solution can be monitored by using one or more measuring devices. For example, an ammeter can be used to directly measuring the current flow through the sample electrolytic solution over time; alternatively, a combination of one or more potentiometers and one or more ohmmeters can be used to measuring the real-time potential and electrical resistance of the sample electrolytic solution, from which the current flow can be calculated.

Preferably, one or more calibration solutions are provided for constructing a correlative data set, which empirically correlates the double layer capacitance with the concentration of an organic component of interest. Specifically, each calibration solution so provided is compositionally identical to the sample electroplating solution but for the concentration of the organic component of interest, and each calibration solution preferably contains said organic component of interest at a unique, known concentration. The double layer capacitance of each calibration solution is measured according to the method described hereinabove and used in conjunction with the respective known concentration of the organic component of interest in each calibration solution to form the correlative data set.

Such correlative data set can then be used for direct mapping of the concentration of the organic component of interest in the sample electroplating solution, based on the double layer capacitance measured for such sample electroplating solution.

Preferably, the present invention employs a computer-based quantitative analyzer, which may comprise a computer, central processor unit (CPU), microprocessor, integrated circuitry, operated and arranged to collect the current response data for determining the double layer capacitance of the sample solution and according to the method described hereinabove and for mapping the organic component concentration. More preferably, such quantitative analyzer has a correlative data set stored in its memory for direct concentration mapping based on the double layer capacitance measured for the sample solution. Alternatively, such quantitative analyzer comprises a capacitance-concentration correlation protocol for in situ construction of such a correlative data set based on current response data collected for various calibration solutions and the respective known organic component concentrations in such calibration solutions. The capacitance-concentration correlation protocol can be embodied in any suitable form, such as software operable in a general-purpose programmable digital computer. Alternatively, the protocol may be hard-wired in circuitry of a microelectronic computational module, embodied as firmware, or available on-line as an operational applet at an Internet site for concentration analysis.

Usage of double layer capacitance for determining organic component concentrations in the present invention is particularly advantageous for analysis of copper electroplating solutions. First, measurement of the double layer capacitance involves little or no reduction of the copper ions ($Cu^{2+}$), because such measurement is carried out in a potential range that is lower than that required for $Cu^{2+}$ reduction reaction, which protects the measuring electrode from being alloyed with the reduced copper and increases the useful life of the electrode. Further, since measurement of the double layer capacitance does not involve copper deposition, the organic additives contained in the sample electrolytic solution are not consumed, and the concentration of such organic additives in the electrolyte solution throughout the measurement cycles remains constant, therefore significantly increasing the reproducibility of the measurement results.

FIG. 1 shows the current response curves of four different electrolytic solutions, which include (1) a first electrolytic solution that contains cupper sulfate, sulfuric acid, and chloride and is additive-free, (2) a second electrolytic solution that is compositionally identical to the first electrolytic solution but for containing a suppressor at a concentration of about 2.0 mL/L; (3) a third electrolytic solution that is compositionally identical to the first electrolytic solution but for containing an accelerator at a concentration of about 6.0 mL/L; (4) a fourth electrolytic solution that is compositionally identical to the first electrolytic solution but for containing a leveler at a concentration of about 2.5 mL/L.

An initial potential step (E) of about −0.208V is applied to each of the above-listed electrolytic solutions, and the current response curves of the electrolytic solutions under such initial potential step are obtained.

The current peak ($I_{max}$) and the time constant ($t_c$) required for the current (I) to drop from the peak value to about 37% of the peak value can be directly read from such current response curves, and from which the double layer capacitance ($C_d$) can be calculated, according to equation (IV) provided hereinabove.

Following is a table listing the measurements obtained from the current response curves shown in FIG. 1.

| | | Solution (1) | Solution (2) | Solution (3) | Solution (4) |
|---|---|---|---|---|---|
| Potential Step (E) | | −0.208 V | −0.208 V | −0.208 V | −0.208 V |
| Current Peak ($I_{max}$) | Ave. | −77.6 nA | −45.1 nA | −58.1 nA | −73.8 nA |
| | RSD | −0.20% | −1.50% | −0.50% | −0.50% |
| Time Constant ($t_c$) | | 0.065 sec. | 0.0749 sec. | 0.0586 sec. | 0.0684 sec. |
| Double Layer Capacitance ($C_d$) | | 24.2 nF | 16.2 nF | 16.4 nF | 24.3 nF |
| Capacitance Change Rate | | 0% | −33% | −32% | 0.04% |

Among the three organic additives tested, the suppressor as added into solution (2) has the greatest impact on the double layer capacitance, and the leveler as added into solution (4) has the least impact at the given concentration. Therefore, different organic additives have relatively different impact on the double layer capacitance, which can be used for distinguishing said organic components from one another.

While the invention has been described herein with reference to specific aspects, features and embodiments, it will be recognized that the invention is not thus limited, but rather extends to and encompasses other variations, modifications and alternative embodiments. Accordingly, the invention is intended to be broadly interpreted and construed to encompass all such other variations, modifications, and alternative embodiments, as being within the scope and spirit of the invention as hereinafter claimed.

What is claimed is:

1. A method for determining concentration of an organic component in a sample electrolytic solution, said method comprising the steps of:

(a) applying a potential step to the sample electrolytic solution by using at least a working electrode and a reference electrode;

(b) measuring double layer capacitance of the working electrode in said sample electrolytic solution under the applied potential step;

(c) determining the concentration of the organic component in said sample electrolytic solution, based on the double layer capacitance measured in step (b), and (d) adding organic component when the concentration of organic component falls below effective electrolytic solution levels, wherein the sample electrolytic solution comprises a copper electroplating solution comprising copper ions, and wherein the copper ions do not deposit onto the working electrode;

wherein the double layer capacitance of the working electrode is measured by monitoring current response of the sample electrolytic solution under the potential step over time; and wherein the current response is measured using at least one measuring device selected from the group consisting of poteniometers, ammeters and ohmmeters.

2. The method of claim 1, wherein the organic component comprises an organic additive selected from the group consisting of suppressors, accelerators, and levelers.

3. The method of claim 1, wherein one or more calibration solutions containing said organic component at unique, known concentrations are provided, wherein the double layer capacitance of the working electrode in each of said calibration solutions under the potential step is measured, which is correlated to the concentration of the organic component in respective calibration solution, and wherein the concentration of the organic component in the sample electrolytic solution is determined based on the double layer capacitance measured for said sample electrolytic solution and the capacitance-concentration correlation obtained by measuring the calibration solutions.

4. The method of claim 3, wherein said one or more calibration solutions are compositionally identical to said sample electrolytic solution but for the organic component concentration.

5. The method of claim 1, wherein the double layer capacitance ($C_d$) of the working electrode is determined by:

$$C_d = \frac{t_c \times I_{\max}}{E}$$

wherein E is the applied potential step, $I_{max}$ is the current peak observed under said applied potential step E, and $t_c$ is a time constant, which is equal to the time required for the current to drop from $I_{max}$ to about $0.368 \times I_{max}$.

6. A method for determining concentration of an organic component in a sample electrolytic solution, said method comprising the steps of:

(a) applying a potential step to the sample electrolytic solution by using at least a working electrode and a reference electrode;

(b) measuring double layer capacitance of the working electrode in said sample electrolytic solution under the applied potential step;

(c) determining the concentration of the organic component in said sample electrolytic solution, based on the double layer capacitance measured in step (b), and (d) adding organic component when the concentration of organic component falls below effective electrolytic solution levels, wherein the sample electrolytic solution comprises a copper electroplating solution comprising copper ions, and wherein the copper ions do not deposit onto the working electrode;

wherein one or more calibration solutions containing said organic component at unique, known concentrations are provided, wherein the double layer capacitance of the working electrode in each of said calibration solutions under the potential step is measured, which is correlated to the concentration of the organic component in respective calibration solution, and wherein the concentration of the organic component in the sample electrolytic solution is determined based on the double layer capacitance measured for said sample electrolytic solution and the capacitance-concentration correlation obtained by measuring the calibration solutions; and wherein the capacitance-concentration correlation data set is stored in a memory of a computational assembly.

7. The method of claim 6, wherein said computation assembly comprises an assembly selected from the group consisting of computers, central processing units (CPUs), mirocprocessors, and integrated circuitry.

8. The method of claim 6, wherein said computational assembly maps concentration of the organic component in said sample electrolytic solution based on the measured double layer capacitance and a correlative data set that empirically correlates double layer capacitance with concentration of the organic component.

9. The method of claim 6, wherein the capacitance-concentration correlation data set is constructed in situ by said computational assembly according to a capacitance-concentration correlation protocol.

10. The method of claim 6, wherein the organic component comprises an organic additive selected from the group consisting of suppressors, accelerators, and levelers.

11. The method of claim 6, wherein said one or more calibration solutions are compositionally identical to said sample electrolytic solution but for the organic component concentration.

12. The method of claim 6, wherein the double layer capacitance of the working electrode is measured by monitoring current response of the sample electrolytic solution under the potential step over time.

13. The method of claim 6, wherein the double layer capacitance ($C_d$) of the working electrode is determined by:

$$C_d = \frac{t_c \times I_{\max}}{E}$$

wherein E is the applied potential step, $I_{max}$ is the current peak observed under said applied potential step E, and $t_c$ is a time constant, which is equal to the time required for the current to drop from $I_{max}$ to about $0.368 \times I_{max}$.

14. A method for determining concentration of an organic component in a sample electrolytic solution, said method comprising the steps of:

(a) applying a potential step to the sample electrolytic solution by using at least a working electrode and a reference electrode;

(b) measuring double layer capacitance of the working electrode in said sample electrolytic solution under the applied potential step;

(c) determining the concentration of the organic component in said sample electrolytic solution, based on the double layer capacitance measured in step (b), and (d) adding organic component when the concentration of organic component falls below effective electrolytic solution levels, wherein the sample electrolytic solution comprises a copper electroplating solution comprising copper ions, and wherein the copper ions do not deposit onto the working electrode; and wherein the organic additives contained in the sample electrolytic solution are not consumed during the measurement of the double layer capacitance.

15. The method of claim 14, wherein organic component comprises an organic additive selected from the group consisting of suppressors, accelerators, and levelers.

16. The method of claim 14, wherein one or more calibration solutions containing said organic component at unique, known concentrations are provided, wherein the double layer capacitance of the working electrode in each of said calibration solutions under the potential step is measured, which is correlated to the concentration of the organic component in respective calibration solution, and wherein the concentration of the organic component in the sample electrolytic solution is determined based on the double layer capacitance measured for said sample electrolytic solution and the capacitance-concentration correlation obtained by measuring the calibration solutions.

17. The method of claim 16, wherein said one or more calibration solutions are compositionally identical to said sample electrolytic solution but for the organic component concentration.

18. The method of claim 14, wherein the double layer capacitance of the working electrode is measured by monitoring current response of the sample electrolytic solution under the potential step over time.

19. The method of claim 18, wherein the current response is measured using at least one measuring device selected from the group consisting of poteniometers, ammeters and ohmmeters.

20. The method of claim 14, wherein the double layer capacitance ($C_d$) of the working electrode is determined by:

$$C_d = \frac{t_c \times I_{\max}}{E}$$

wherein E is the applied potential step, $I_{max}$ is the current peak observed under said applied potential step E, and $t_c$ is a time constant, which is equal to the time required for the current to drop from $I_{max}$ to about $0.368 \times I_{max}$.

* * * * *

UNITED STATES PATENT AND TRADEMARK OFFICE

CERTIFICATE OF CORRECTION

PATENT NO. : 7,427,344 B2
APPLICATION NO. : 11/318129
DATED : September 23, 2008
INVENTOR(S) : Jianwen Han It is certified that error appears in the above-identified patent and that said Letters Patent is hereby corrected as shown below:

Cover page, item [75], inventors, "MacKenzie E. King" should be -- Mackenzie E. King --.

Signed and Sealed this

Thirtieth Day of December, 2008

JON W. DUDAS
*Director of the United States Patent and Trademark Office*